US005938167A

United States Patent [19]

Collet et al.

[11] Patent Number: 5,938,167

[45] **Date of Patent: *Aug. 17, 1999**

[54] CHRISTMAS TREE STAND

[75] Inventors: Bernt Johan Collet, Lundby; Peter Ferdinand Collet, Køge, both of Denmark

[73] Assignee: Skovbunden Aps, Lundby, Denmark

[ * ] Notice: This patent issued on a continued prosecution application filed under 37 CFR 1.53(d), and is subject to the twenty year patent term provisions of 35 U.S.C. 154(a)(2).

[21] Appl. No.: 08/750,172

[22] PCT Filed: May 31, 1995

[86] PCT No.: PCT/DK95/00213

§ 371 Date: Dec. 2, 1996

§ 102(e) Date: Dec. 2, 1996

[87] PCT Pub. No.: WO95/32655

PCT Pub. Date: Dec. 7, 1995

[30] Foreign Application Priority Data

Jun. 1, 1994 [DK] Denmark ..... 0619/94

[51] Int. Cl.[6] ..... F16M 13/00

[52] U.S. Cl. ..... 248/516; 47/40.5; 248/523; 248/526

[58] Field of Search ..... 47/40.5; 248/527, 248/516, 519, 523, 526, 288.31, 288.51, 181.2, 181.1, 179.1, 398

[56] References Cited

U.S. PATENT DOCUMENTS

| | | | |
|---|---|---|---|
| 2,014,896 | 9/1935 | Hollander | 248/527 X |
| 2,893,668 | 7/1959 | Applegate | 47/40.5 X |
| 3,661,349 | 5/1972 | De Vries | 47/40.5 |
| 4,007,901 | 2/1977 | Mancini et al. | 248/519 |
| 4,571,882 | 2/1986 | Capen | 47/40.5 |
| 4,676,471 | 6/1987 | Moore | 248/526 |
| 4,834,335 | 5/1989 | Attar | 248/527 X |
| 4,949,502 | 8/1990 | Anderson | 47/40.5 |
| 5,393,031 | 2/1995 | Leve | 47/40.5 X |
| 5,398,444 | 3/1995 | Murray | 47/40.5 |
| 5,673,893 | 10/1997 | Klein | 248/525 |

FOREIGN PATENT DOCUMENTS

| | | | |
|---|---|---|---|
| 465471 | 5/1950 | Canada | 47/40.5 |
| 3421733 | 12/1985 | Germany | 47/40.5 |
| 7902820 | 10/1980 | Netherlands | 47/40.5 |

*Primary Examiner*—Derek J. Berger
*Attorney, Agent, or Firm*—Watson Cole Grindle Watson, P.L.L.C.

[57] ABSTRACT

A Christmas tree stand for positioning and securing a tree. The stand includes a tree holder, which has a substantially spherical portion and a fastening portion for affixing the holder to the tree, and a base which has at least three pivotable legs for securing the holder and a receiving portion for receiving the holder. Each of the legs is positioned in such a way that the tree's intrinsic weight causes the legs to press against the holder, thereby securing the holder and the tree. The receiving portion and the legs are constructed with mutually cooperating parts to allow the legs be positioned in an intermediate position when the stand rests on a support, and to allow the holder, which is secured to the tree, to be inserted into the receiving portion of the stand.

11 Claims, 7 Drawing Sheets

8
9
20
19A
23
7
10
14
24
20
22
22
12
11

CHRISTMAS TREE STAND

BACKGROUND OF THE INVENTION

1. Technical Field of Invention

The present invention relates to a Christmas tree stand comprising a base structure and a holding device where at least a portion of the holding device is approximately spherical and provided with means for securing the latter in the end portion of the tree.

2. Background Art

From e.g. WO 94/06332 a Christmas tree stand is known which comprises a holding device in the form of a disc which is to be screwed into to the end portion of the tree and a base structure with three legs. The base structure is provided with an engagement portion for the holding device which serves to prevent horizontal displacement of the two portions relative to each other. The three legs serve to ensure the vertical position of the tree, as they abut on the tree bole. It is only to a limited degree possible to straighten up a Christmas tree positioned in such known Christmas tree stand and when possible only by manual adjustment of the legs' position which does not allow one single person to carry out simultaneous adjustment and control of the positioning. When the bole of the tree is uneven or in any other way irregular, such adjustment and maintaining in position of a tree is further complicated. Thus, in case of this prior art Christmas tree stand, it may be necessary to support one or more legs with wedges to obtain desired straightening of the tree in a vertical position.

The publications U.S. Pat. No. 2,893,658, U.S. Pat. No. 2,997,264, U.S. Pat. No. 4,571,882 and DE 3 601 601 describe Christmas tree stands comprising a spherical portion to be secured to the end portion of the tree and a base structure for receiving and securing the spherical portion. In these prior art references, the securing is realized by threaded clamping parts or spring activated clamping parts. The securing requires manual operation of these clamping parts. This renders it difficult for one single person to arrange the tree in the correct position and at the same time activate the clamping means.

SUMMARY OF THE INVENTION

It is thus the object of the invention to provide a Christmas tree stand which allows positioning and securing of a tree by one single upright operator.

This object is obtained with a Christmas tree stand of the type described above which is characterized in that the base structure comprises parts constructed to press against the spherical portion of the holding device by influencing the base structure with the tree's intrinsic weight and thereby securing the holding device.

The holding device being at least approximately spherical and the base structure being constructed to press against the holding device and not against the tree bole permit pivoting of the tree to any position about the centre of the spherical portion. In this context the straightening may for example be carried out steplessly. This is conveniently obtained by the structure comprising at least three support elements which are constructed to press against the spherical portion of the holding device by influencing the base structure with the intrinsic weight of the tree.

In a preferred embodiment the base structure of the Christmas tree stand comprises a central receiving portion for receiving the holding device and at least three support elements hinged pivotally relative to the central receiving portion in such a way that upon influencing the receiving portion with the tree's intrinsic weight by means of the holding device, the support elements will press against the holding device and thereby secure it.

According to a further advantageous embodiment the supporting elements are pivotably movable about axes which are below the centre of the spherical portion of the holding device in a final position of the tree. Hereby favourable conditions for the power influence of the holding device are obtained.

In order to facilitate the insertion of the holding device in the base structure the receiving portion and the support elements are constructed with mutually cooperating parts which allow the legs to be positioned in an intermediate position where the stand may rest on the support, and the holding device secured to the tree may be inserted into the receiving portion of the stand.

The base structure may consist of a number of disc elements where one or more legs are secured to each disc element and where each disc element is connected to an adjacent disc element with a hinge connection which permits rotation about several axes. This ensures that the holding device receiving section of the base structure is opened when unloaded and does not influence the holding device by friction. It also ensures easy insertion of the holding device into the base structure.

According to a particularly advantageous embodiment, the legs of the base structure may be made of such material and have such thickness which permits limited deformation of the legs when a tree is positioned in the stand. This is important when the support on which the stand is disposed is irregular and it is particularly relevant when the stand comprises more than three legs.

The holding device is advantageously designed with or provided with a threaded part to be screwed into the tree where the approximately spherical portion of the holding device and the threaded part can moreover be made in one piece.

In order to further ensure that the tree is solidly arranged, the stand may comprise means to lock the holding device relative to the base structure following final positioning of the tree, where the means for securing the position of the holding device relative to the base structure consist of e.g. a clip, a ring or the like which causes the legs to press against the spherical portion of the holding device. In a state where the Christmas tree stand with the tree is disposed on a support, e.g. a clip or a ring will increase the pressure exerted by the legs on the holding device. Such means for securing the holding device and the base structure to each other further allows the tree with the mounted stand to be moved without ensuing release of the base structure from the holding device.

To ensure the grip of the base structure on the holding device, the latter may be constructed with ribs extending radially outwards relative to and substantially parallel to a central axis of the holding device.

To ensure improved longevity of the tree means may be provided in connection with the stand for holding and supplying fluid to the tree. The means may e.g. consist of a sponge arranged in connection with the holding device in such a manner that the end portion of the tree is in contact with the sponge when the holding device has been positioned. A dish may alternatively be provided in connection with the holding device so that the end portion of the tree is maintained under water when the holding device is mounted.

BRIEF DESCRIPTION OF THE DRAWINGS

Exemplary embodiments of the invention will be described in the following with reference to the drawings, wherein.

DETAILED DESCRIPTION OF THE PREFERRED EMBODIMENTS

Figure 1:
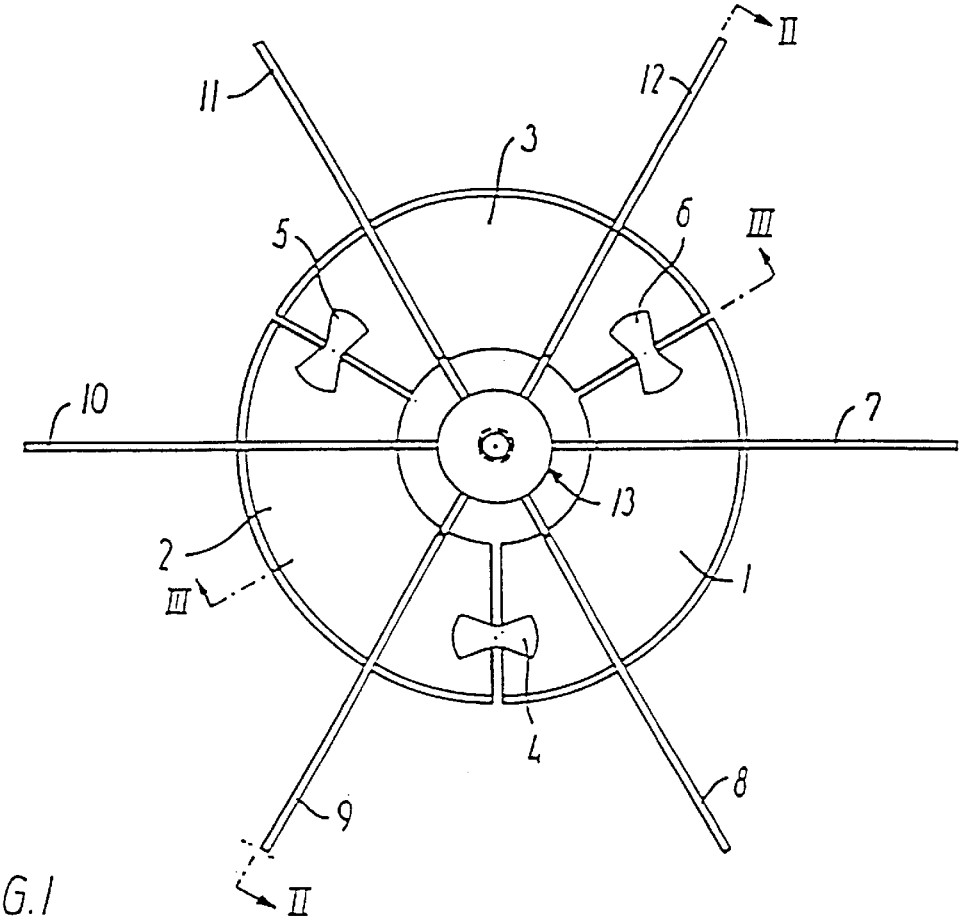
FIG. 1 is a top plane view of a Christmas tree stand according to the invention.

FIG. 1 shows a top plan view of a Christmas tree stand comprising three disc elements 1,2,3 each of which constitutes one portion of a ring and is mutually connected by hinge elements 4,5,6. To each disc element 1,2,3 two legs 7-12 are secured. Between the legs 7-12 a holding device 13 is fastened which has a spherical portion 14 and a threaded part 15 to be screwed into the end portion of a Christmas tree.

Figure 2:
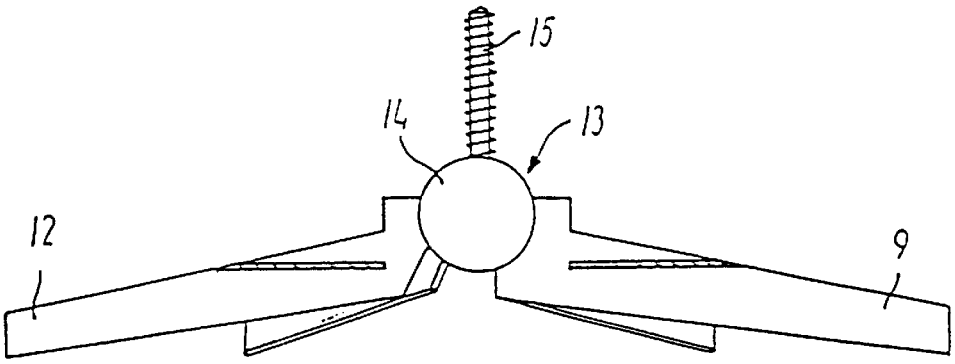
FIG. 2 is a sectional view along the line II—II in FIG. 1.

As will appear more clearly from FIG. 2, the securing of the holding device is a result of the intrisic weight of the tree weighing upon the legs of the base structure. The reaction force from the support of the legs thus causes the leg to rotate about the rotational axis which is constituted of the hinge connection between the disc elements, and thus results in a pressure influence on the spherical portion 14 of the holding device 13 with the adjacent end portion of the legs which end portion is designed to substantially match the shape of the holding device in an abutment area.

Figure 3:
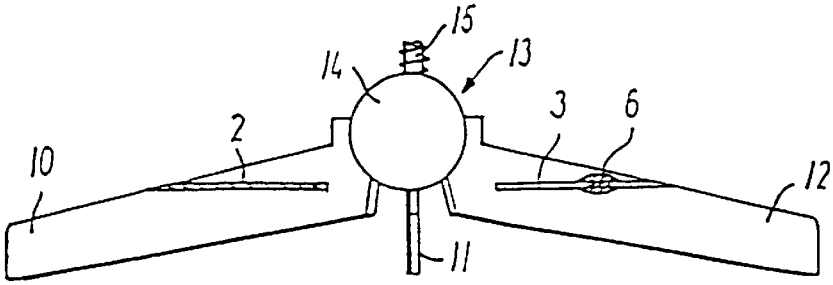
FIG. 3 is a sectional view along the line III—III in FIG. 1, FIGS. 4A, 4B and 4C are sectional views through holding devices without and with means for holding and supplying fluid.

FIG. 3 is a sectional view of an exemplary hinge communication. In this case it may be an elastic material which permits rotation about two axes which has the practical consequence that the material is distorted. This may be effected e.g. by means of a hinge 6 made of elastic material such as rubber or a soft plastics material and it may in a particularly advantageous embodiment be provided integrally with the disc elements. A corresponding effect may be obtained with e.g. a spherical joint connection 6'.

Figure 4B:
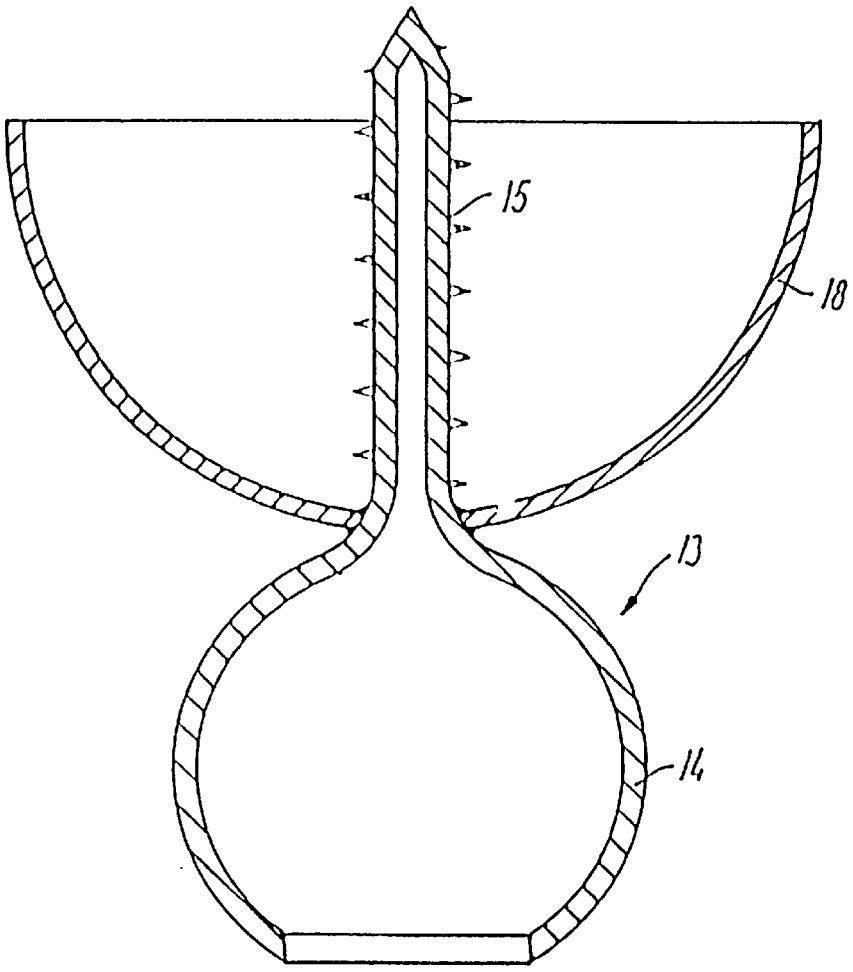
Figure 4A:
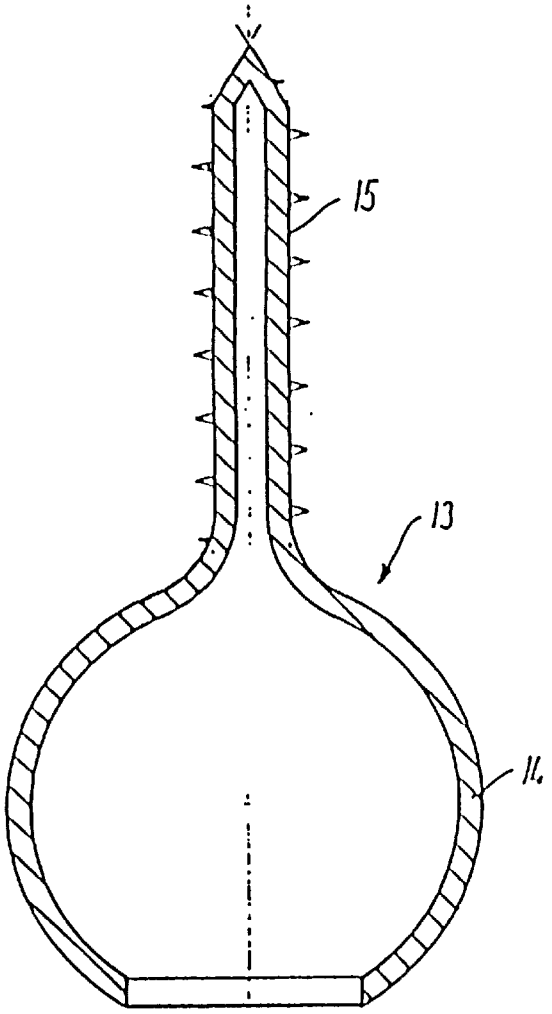

FIG. 4A is an exemplary embodiment of a convenient holding device with integral spherical and threaded parts. This provides simple and rational production of this element.

Figure 4C:
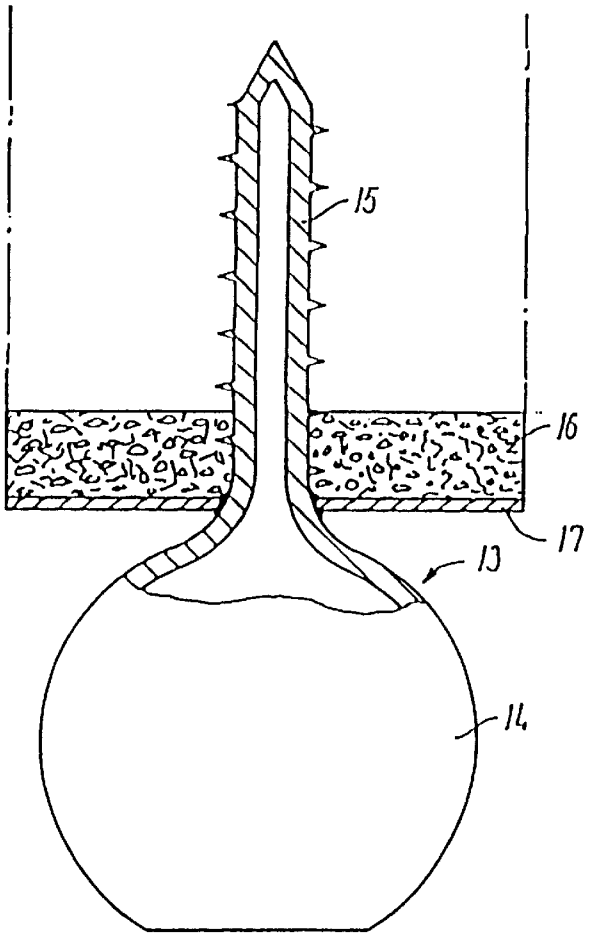

FIGS. 4B and 4C show how such holding device may be provided with means for holding and supplying fluid to the tree. FIG. 4B is a dish element 18 which is integral with the holding device, and FIG. 4C shows a sponge 16 which is supported by a board 17 wherein these elements are mounted around the threaded part of the holding device.

Figure 5:
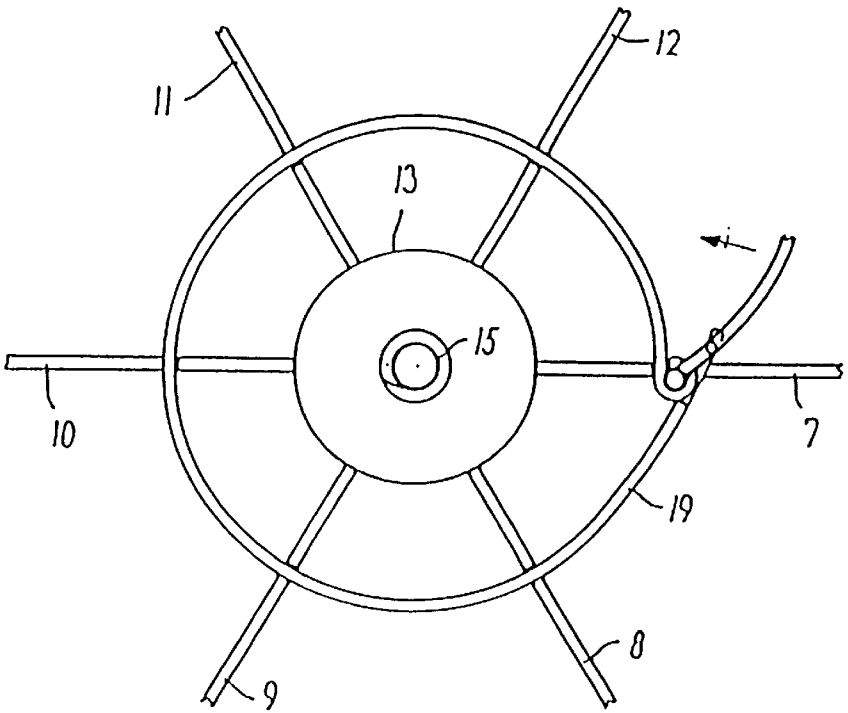
FIG. 5 is a top plan view of a portion of a Christmas tree stand according to the invention provided with a locking device.

In order to further ensure that the tree is maintained in its final position a locking device (19) in the form of a clip like the one shown in FIG. 5 may be provided which clip is fastened around the legs on the sides which face the holding device and thus influences the sides with an additional pressure force towards the spherical portion.

Figure 6:
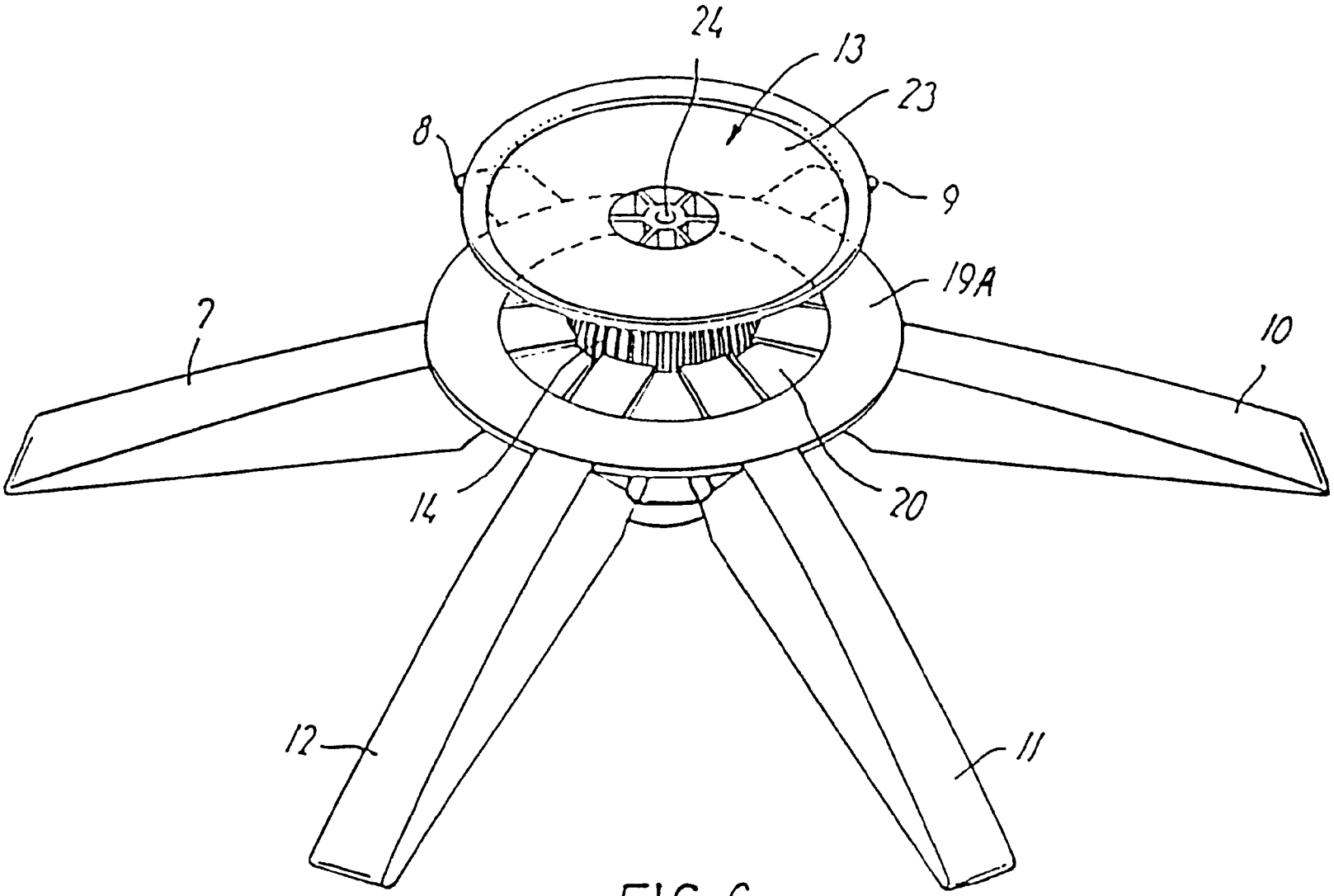
FIG. 6 is a perspective view of a preferred embodiment of the Christmas tree stand according to the invention.
Figure 7:
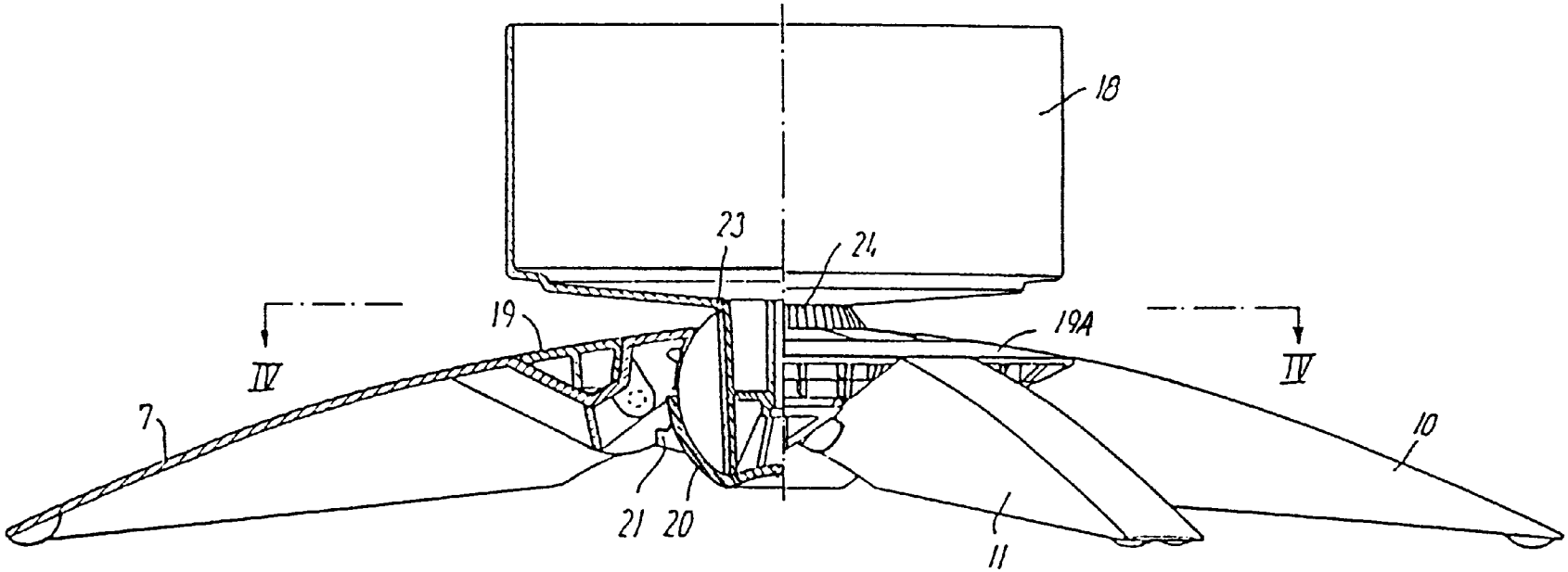
FIG. 7 is a partially sectional side view and partially cut-away sectional view of the Christmas tree stand shown in FIG. 6.
Figure 8:
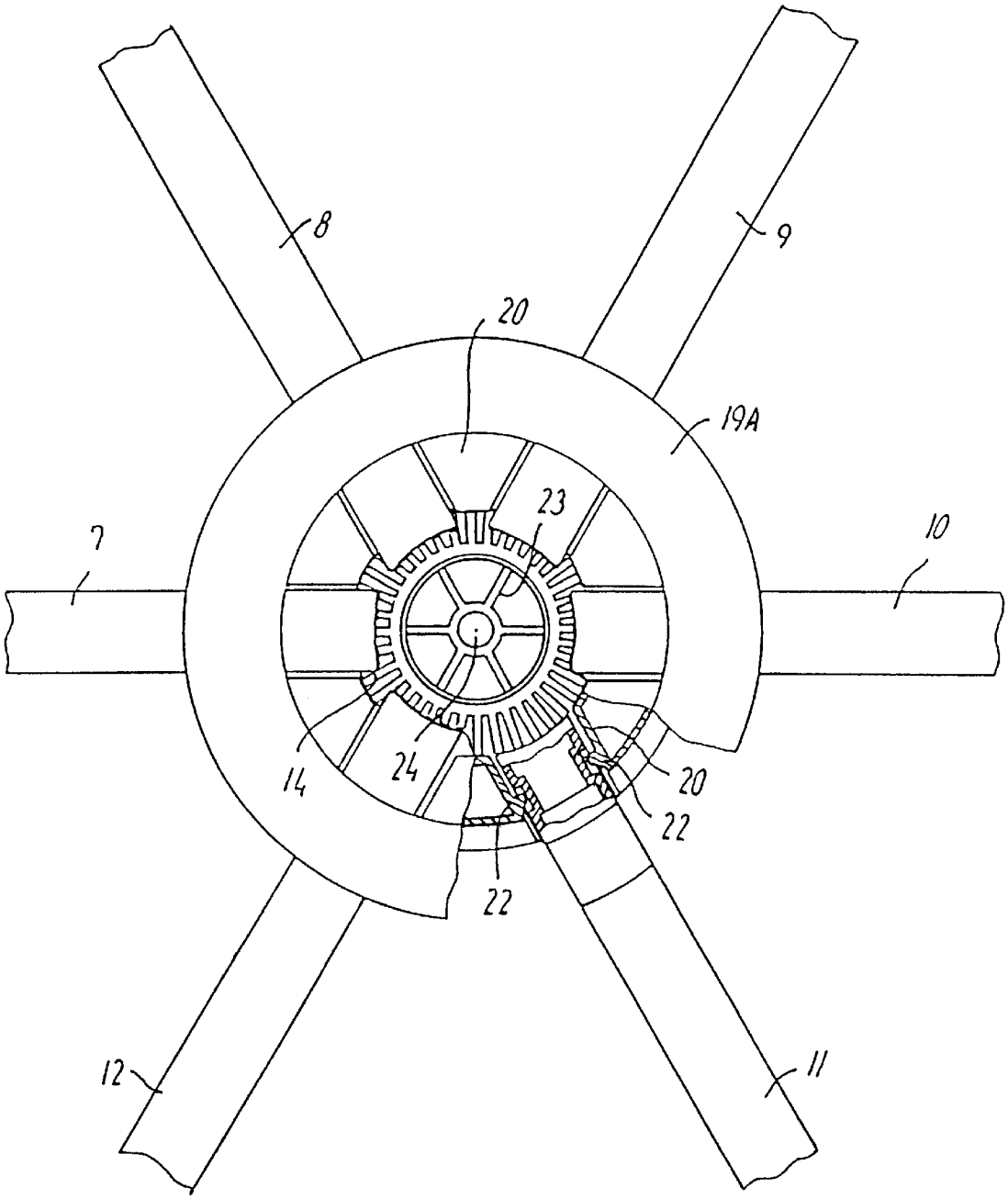
FIG. 8 is a partially cut-away sectional view along the line of the Christmas tree stand shown in FIG. 6.

FIG. 6 shows a perspective view of a preferred embodiment of the Christmas tree stand according to the invention. The base structure of this stand comprises a central receiving portion 20 for receiving the holding device. On the receiving portion, six support elements or legs are pivotably hinged in such a way that they press against the spherical portion of the holding device when this portion is inserted into the receiving portion and therein activates the base structure with the intrinsic weight of the tree fastened to the holding device. This is shown in FIGS. 7 and 8 which are a partially sectional side view and a top plan view, respectively, of the preferred embodiment. FIGS. 6–8 further show a securing ring 19A which is mounted in grooves in the support elements and hereby press the latter further against the spherical portion of the holding device. In a mounted position of the securing ring 19A, the tree can be lifted while the stand remains in the correct position.

Each leg is mounted on the central receiving portion by means of hinge tabs 22 on the receiving portion which tabs correspond with grooves in the legs.

Figure 9:
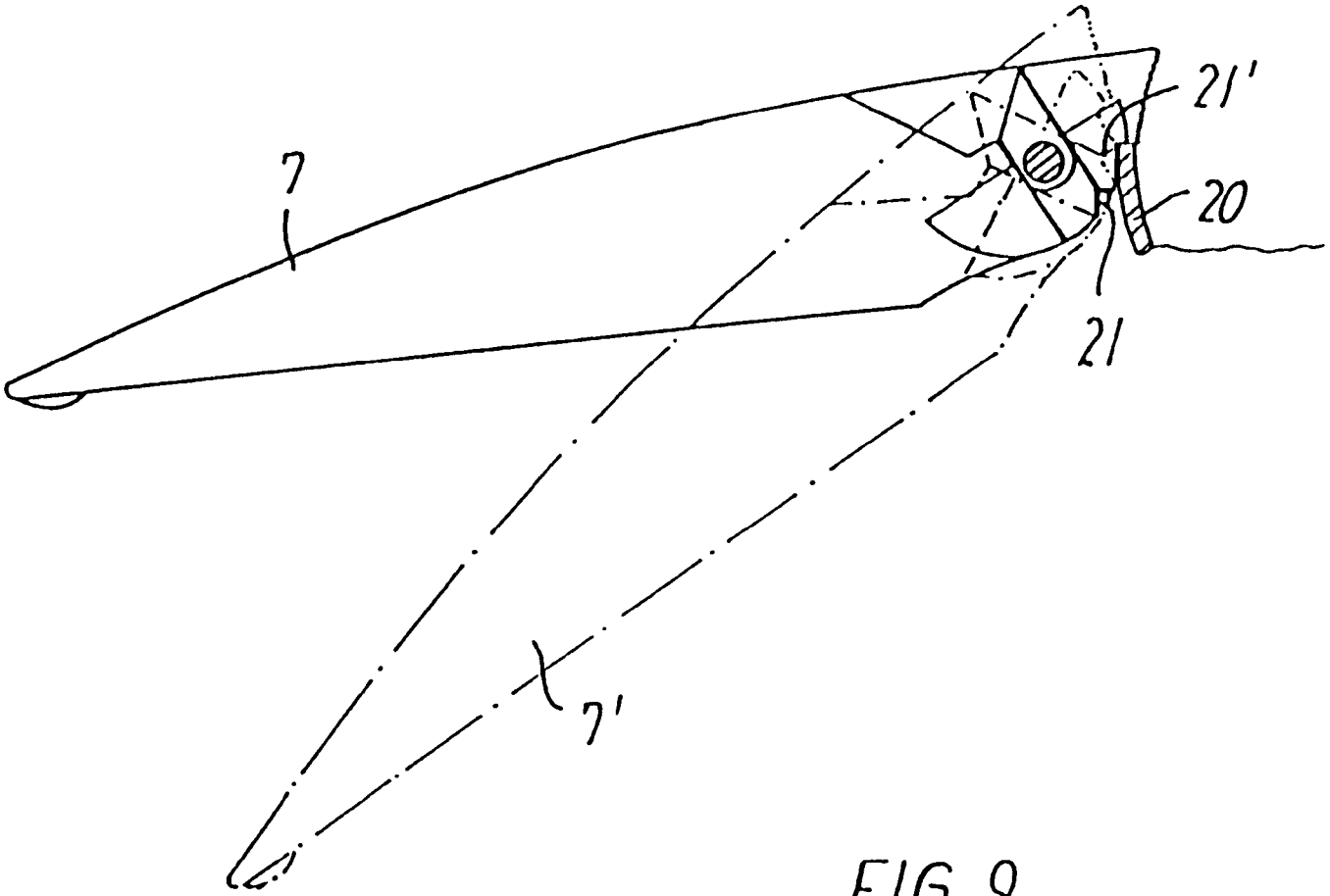
FIG. 9 is a side view of a leg and a part of a receiving portion showing the leg in an intermediate and a final position.

Each support element 7-12 is designed with a cut-out 21 which may cooperate with an edge of the receiving portion in order to place the support elements in an intermediate position where the stand may be placed on the support and where the spherical portion of the holding device may be inserted into the central receiving portion of the base structure. This is shown in FIG. 9 which illustrates the intermediate position of a support element 7' and cut-out 21' with a dash-dotted line.

As it appears in particular from FIG. 8, the spherical portion 14 of the holding device has ribs extending radially relative to and parallel to the central axis 24 of the holding device. The ribs extend from a sleeve which has on the inside a slightly conical shape. The sleeve 23 is mounted on a central holding device portion having on the outside a corresponding conical shape. In this central portion 23 a hole for a screw is formed. However, the screw is not shown in the drawing. The central portion 23' and 23" may extend into a disc as shown in FIG. 6, or a dish or a bowl for holding and supplying water to the tree as shown in FIG. 7.

This preferred embodiment of the Christmas tree stand according to the invention is preferably made of a plastics material by an injection moulding process.

What is claimed is:

1. A Christmas tree stand for positioning and securing a tree comprising:

a holding device having a generally spherical portion and means for securing the holding device to an end portion of the tree; and a base structure comprising a central receiving portion for receiving the holding device, and at least three pivotable support elements hinged to the central receiving portion in such a manner that application of a downward force from the tree's intrinsic weight to the base structure via the holding device adapted to influence the support elements to press against the generally spherical portion of the holding device, thereby securing the holding device.

2. The Christmas tree stand according to claim 1, wherein the receiving portion and the support elements are constructed with mutually cooperating parts to allow the support elements to be positioned in an intermediate position when the stand rests on a support, and to allow the holding device, when secured to the tree, to be inserted into the receiving portion of the base.

3. The Christmas tree stand according claim 1, wherein the support elements are pivotally movable about axes which are below the center of the spherical portion of the holding device in a final position of the tree.

4. The Christmas tree stand according to claim 1, wherein the means for securing the holding device to the end portion of the tree comprises a threaded part for screwing into the tree.

5. The Christmas tree stand according to claim 4, wherein the spherical portion of the holding device and the threaded part are made in one piece.

6. The Christmas tree stand according claim 1, wherein the support elements of the base structure are made of such material and have such thickness which permit limited deformation of the support elements when the tree is arranged in the stand.

7. The Christmas tree stand according claim 1, further comprising means for locking the base structure relative to the holding device following final positioning of the tree.

8. The Christmas tree stand according claim 1, wherein the stand includes means for holding and supplying liquid to the tree.

9. A Christmas tree stand for positioning and securing a tree comprising:

a holding device having a generally spherical portion and means for securing the holding device to an end portion of the tree;

a base structure having at least three pivotable support elements for securing the holding device; wherein each of the support elements is positioned in such a way that the tree's intrinsic weight is adapted to cause the support elements to press against the holding device, and wherein the base structure comprises a plurality of disc elements secured and positioned in an adjacent manner and hinge connection means for fastening the support elements onto the disc elements, wherein the hinge connection means permit rotation of said disc elements about at least two axes.

10. The Christmas tree stand according to claim 9, wherein the hinge connection means is made of elastic material.

11. A Christmas tree stand for positioning and securing a tree comprising:

a holding device having a generally spherical portion and means for securing the holding device to an end portion of the tree;

a base structure having at least three pivotable support elements for securing the holding device; and means for locking the base structure relative to the holding device following final positioning of the tree, wherein each of the support elements is positioned in such a way that application of a downward force to the base structure from the tree's intrinsic weight is adapted to cause the support elements to press against the holding device, and wherein the means for locking the base structure relative to the holding device comprises a ring which urges the support elements towards the spherical portion.

* * * * *